US007360584B2

(12) United States Patent
Hunzinger et al.

(10) Patent No.: US 7,360,584 B2
(45) Date of Patent: Apr. 22, 2008

(54) THERMAL RELIEF MECHANISM FOR COMBINATION-TYPE HEAT EXCHANGERS

(75) Inventors: Thomas A. Hunzinger, Racine, WI (US); Ken Nakayama, Racine, WI (US); David M. Scoville, Kenosha, WI (US)

(73) Assignee: Modine Manufacturing Company, Racine, WI (US)

( * ) Notice: Subject to any disclaimer, the term of this patent is extended or adjusted under 35 U.S.C. 154(b) by 115 days.

(21) Appl. No.: 11/272,659

(22) Filed: Nov. 14, 2005

(65) Prior Publication Data

US 2006/0108101 A1 May 25, 2006

Related U.S. Application Data

(60) Provisional application No. 60/629,531, filed on Nov. 19, 2004.

(51) Int. Cl.
*F28D 7/16* (2006.01)

(52) U.S. Cl. ..... 165/140; 165/81

(58) Field of Classification Search ..... 165/81, 165/140, 152, 153, 173–175
See application file for complete search history.

(56) References Cited

U.S. PATENT DOCUMENTS 5,954,123 A * 9/1999 Richardson ..... 165/81
6,412,547 B1 * 7/2002 Siler ..... 165/81
2002/0040776 A1 * 4/2002 Kokubunji et al. ..... 165/140
2003/0213587 A1 * 11/2003 Mano et al. ..... 165/174
2005/0006069 A1 * 1/2005 Kamiyama et al. ..... 165/140
2005/0133207 A1 * 6/2005 Scoville et al. ..... 165/140

FOREIGN PATENT DOCUMENTS

EP 1 477 757 A2 11/2004
EP 1 477 758 A2 11/2004
EP 1 477 760 A2 11/2004

* cited by examiner

*Primary Examiner*—Teresa J. Walberg
(74) *Attorney, Agent, or Firm*—Michael Best & Friedrich LLP

(57) ABSTRACT

A multi-fluid heat exchanger and a method of making the same are provided wherein a cut portion is provided in an elongated header of the heat exchanger at a location between a pair of baffles in the elongated header and first and second cores of the heat exchanger. At least a majority of the transverse cross section of the elongated header is removed at the cut portion to allow for relative thermal growth of the first and second cores.

19 Claims, 6 Drawing Sheets

THERMAL RELIEF MECHANISM FOR COMBINATION-TYPE HEAT EXCHANGERS

FIELD OF THE INVENTION

This invention relates to heat exchangers and more particularly to combination-type heat exchangers wherein heat exchangers for two or more fluids share a common manifold or header, and in more particular applications, to such heat exchangers as used in vehicular systems, such as automobiles, buses, trucks, etc.

BACKGROUND OF THE INVENTION

It is known to form a so-called "combination" or "combo" type heat exchanger by including one or more baffles in each of the manifolds or headers of the heat exchanger to divide the interiors of each of the headers into at least a first section for a first working fluid and a second section for a second working fluid with each of the working fluids being directed through the respective heat exchange tubes that are connected to the respective sections of the common manifolds. While such constructions may be suitable for their intended purposes, problems can arise when there are large temperature differentials between the different working fluids in each section of the shared manifold, particularly for constructions where the cores or tubes for each of the working fluids are assembled in the same plane, such as, for example, in parallel flow constructions. Accordingly, there is a continued need for improvement in combo heat exchangers.

SUMMARY OF THE INVENTION

The invention reduces the strain on heat exchanger core tubes by sectioning or partially sectioning one or both common headers in a combination type heat exchanger. The invention also allows the heat exchanger to be assembled using conventional methods. The invention provides for the possibilities of cutting the headers during or after core assembly, or after brazing. Cutting can be accomplished by various methods such as sawing or punching.

The option of partially sectioning or cutting the header allows the heat exchanger to be installed intact into a system, and have the header sections break apart during thermal events in the vehicle. Also, partially cutting the headers can be done prior to cores assembly, and the final cutting can be done during or after core assembly.

In accordance with one form of the invention, a multi-fluid heat exchanger is provided for transferring heat between a first fluid and a common fluid in one part of the heat exchanger and between the second fluid and a common fluid in a second part of the heat exchanger. The heat exchanger includes first and second elongated header pipes, first and second core sections, and a pair of baffles in the first header pipe. The first elongated header pipe has a plurality tube receiving opening spaced along a length of the first header pipe. The second elongate header pipe has a plurality of tube receiving openings spaced along a length of the second header pipe. The first core section includes a plurality of parallel, spaced tubes, each of the tubes having a first end and a second end, with the first end received in a corresponding one of the tube receiving openings of the first header pipe and the second end received in a corresponding one of the tube receiving openings of the second header pipe to direct the first fluid between the first and second header pipes through an interior of the tube. The second core section comprising a plurality of parallel, spaced tubes, each of the tubes having a first end and a second end, with the first end received in a corresponding one of the tube receiving openings of the first header pipe and the second end received in a corresponding one of the tube receiving openings of the second header pipe to direct the second fluid between the first and second header pipes through an interior of the tube. The second core is spaced from the first core along the lengths of the first and second header pipes. The pair of baffles are located in the first header pipe at a location between the first and second cores to divide an interior of the first header pipe into a first fluid manifold for the first fluid and a second fluid manifold for the second fluid. The first header pipe includes a cut portion located between the pair of baffles, the cut portion having at least a majority of a transverse cross section of the header pipe removed in comparison to the immediately adjacent transverse cross sections of the first header pipe.

In one feature, the cut portion is sized so that any remaining part of the transverse cross section of the first header pipe at the cut portion is severed under thermal cycling of the heat exchanger during operation of the heat exchanger.

As one feature, all of the transverse cross section of the first header pipe has been removed in the cut portion, so that the first header pipe is separated into two unconnected pieces.

In accordance with one feature, one of the tube openings of the first header pipe is located at the cut portion.

In a further feature, the one of the tube openings of the first header pipe doe not have a tube end received therein.

According to a further feature, the cut portion is defined by at least one saw cut extending through a portion of the header pipe outside of the one of the tube openings.

As a further feature, the cut portion is defined by a saw cut extending through a side of the header pipe immediately opposite from the one of the tube openings.

In accordance with a further feature, the cut portion is defined by a saw cut extending through the one of the tube openings.

In one feature, the cut portion is defined by a pair of saw cuts extending through opposite respective sides of the first header pipe.

According to one feature, the cut portion is characterized by the absence of any of the tube openings.

In one feature, there is a serpentine fin extending between the first and second cores and connected to both the first and second cores.

As one feature, the heat exchanger includes another pair of baffles located in the second header pipe at a location between the first and second cores to divide an interior of the second header pipe into a first fluid manifold for the first fluid and a second fluid manifold for the second fluid, the second header pipe including a second cut portion located between the another pair of baffles, the second cut portion having at least a majority of a transverse cross section of the header pipe is removed in comparison to the immediately adjacent transverse cross sections of the first header pipe.

In accordance with one feature of the invention, a method is provided for making a multi-fluid heat exchanger for transferring heat between a first fluid and a common fluid in one part of the heat exchanger and between a second fluid and the common fluid in a second part of the heat exchanger. The method includes the steps of:

a) providing a heat exchanger with first and second parallel flow core sections extending between a pair of elongated header tubes, with each of the tubes having a first fluid manifold for the first core section and a second fluid for the second core section;

b) providing a cut portion in one of the elongated headers at a location between the first and second manifolds, the cut portion having at least part of the header connecting the first and second manifolds of the header;

c) thermal cycling the heat exchanger to severe the at least part of the one of the elongated headers so that the first and second manifolds of the header are no longer connected at the cut portion.

As one feature, step b) includes providing the cut portion after the first and second core seconds are assembled and brazed together with the pair of elongated headers.

As another feature, step b) includes providing the cut portion before the first and second core seconds are assembled and brazed together with the pair of elongated headers.

DETAILED DESCRIPTION OF THE PREFERRED EMBODIMENT

Figure 1:
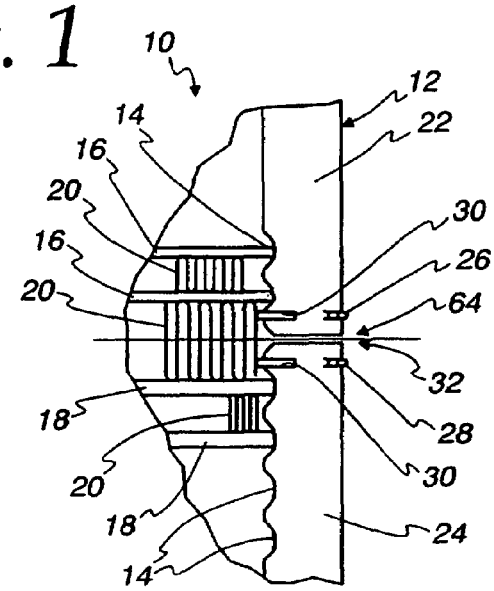
FIGS. 1-5B are views of a combo heat exchanger including a thermal relief mechanism embodying the present invention.
Figure 2:
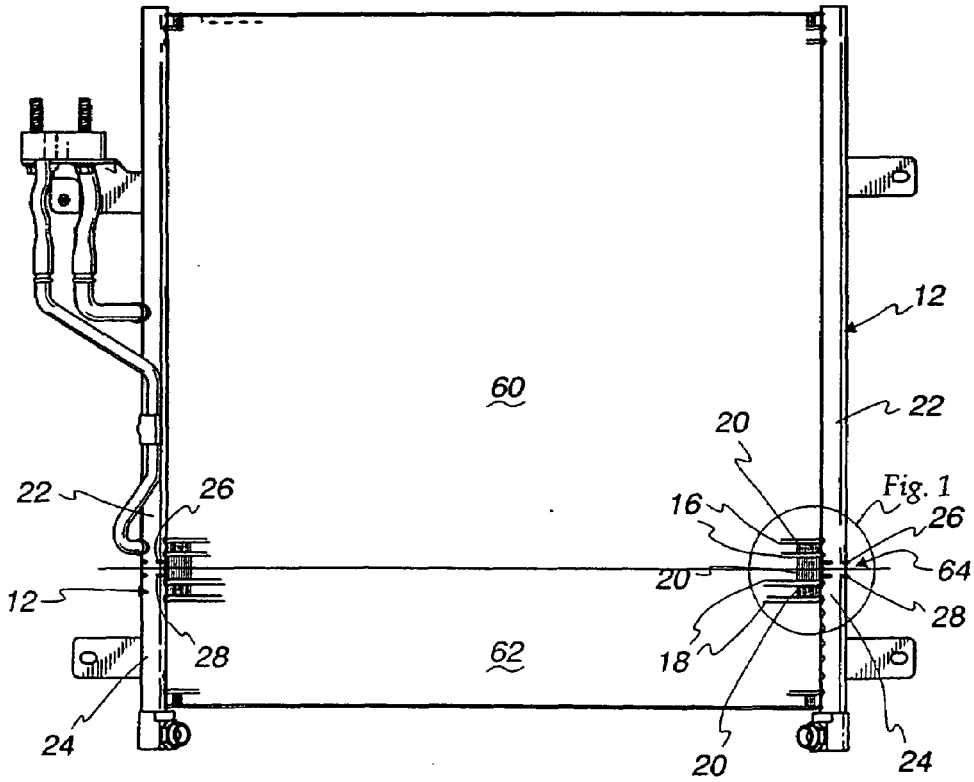
Figure 3:
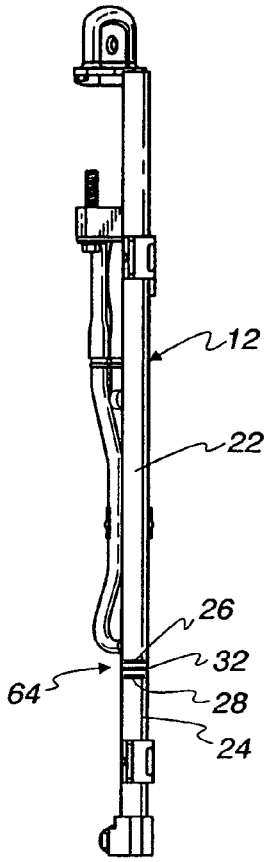
Figure 4:
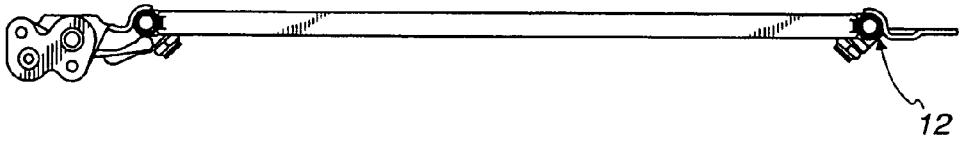
Figure 5A:
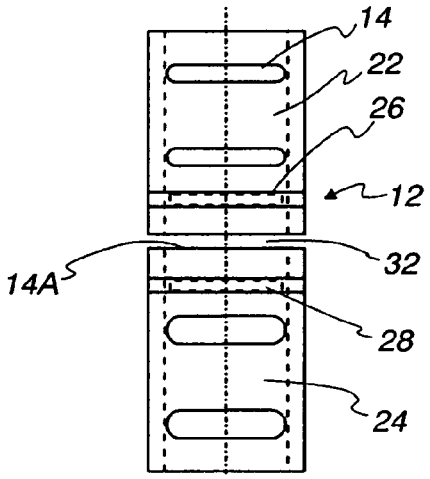
Figure 5B:
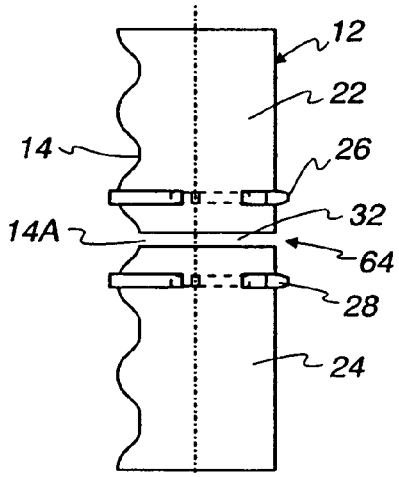

FIG. 1 shows a portion of a combination cooler embodying a multi-fluid heat exchanger of the present invention. The combo cooler 10 includes a common manifold or header 12 in the form of an essentially cylindrical tube that has pierced tube slots 14 to receive the flattened heat exchanger tubes 16 and 18, respectively, that direct their respective first and second heat exchange fluids through the combo heat exchanger 10 so that heat can be transferred between the first and second working fluids to a third fluid, typically air, that flows over the exterior of the tubes 16,18 and passes through a plurality of serpentine fins 20 that are positioned between adjacent pairs of the tubes 16 and 18. The manifold 12 includes a first section 22 for the first fluid and a second section 24 for the second fluid, with the first and second sections being separated by a pair of baffles 26 and 28 that have been inserted through cut baffle slots 30 in the manifold 12 and brazed in place during the common brazing operation that brazes all of the tubes 16,18, fins 20, and headers 12 together. A saw cut 32 is located between the baffles 26 and 28 at the location of a pierced tube slot 14A. The cut 32 is created after the remainder of the heat exchanger 10 has been assembled and brazed together. This saw cut 32 is further illustrated in FIGS. 5A and 5B, and the full heat exchanger is shown in FIGS. 2-4. As best seen in FIG. 2, in some applications it may be desirable to include the saw cut 32 in only one of the headers 12.

FIGS. 6A-6B, 7A-7B, 8A-8B, 9A-9B, 10A-10B, and 11A-11C show alternate embodiments to the saw cut of FIGS. 1-5B.

Figure 6A:
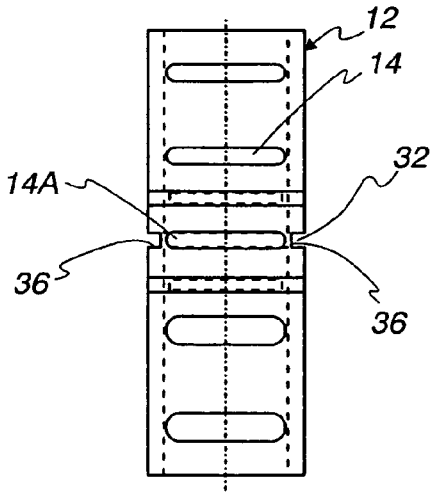
FIGS. 6A-11C are views of alternate embodiments of the invention.
Figure 6B:
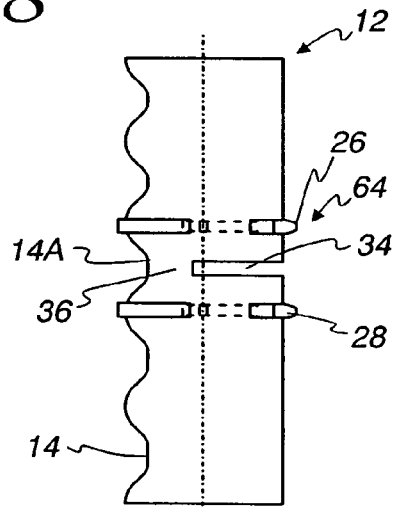

More specifically, FIGS. 6A and 6B show an alternate embodiment wherein a partial saw cut 34 extends from the side of the manifold 12 opposite the tube slots 14 so as to leave a pair of connection tabs 36 that extend between the tube slot 14A and the saw cut 34.

Figure 7A:
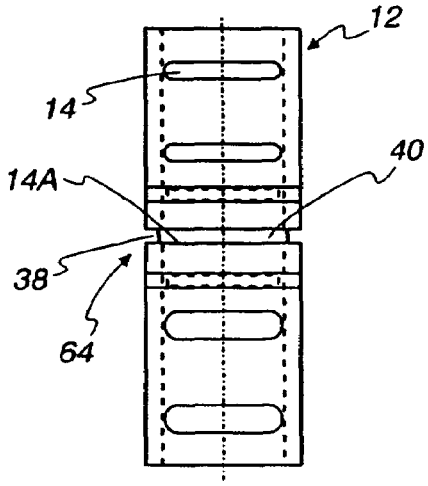
Figure 7B:
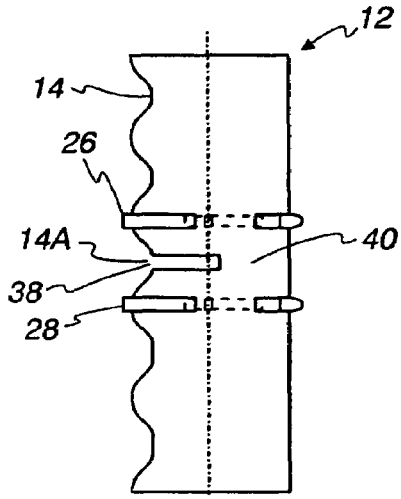

FIGS. 7A and 7B show an alternate embodiment wherein a partial saw cut 38 is made on the same side of the manifold as the tube slots 14A so as to leave a circumferential connection tab 40 on the side of the manifold 12 opposite from the tube slots 14.

Figure 8A:
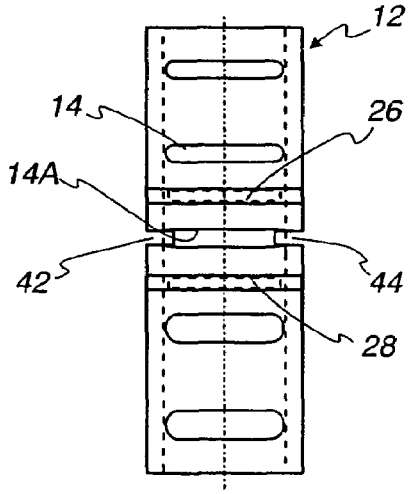
Figure 8B:
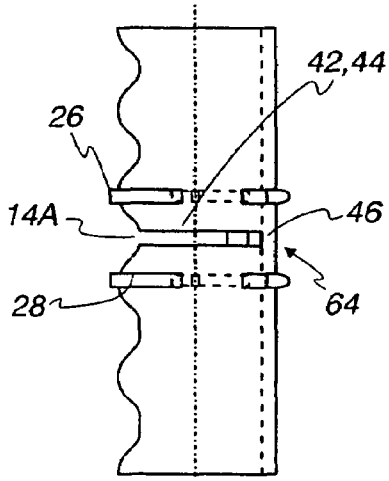

FIGS. 8A and 8B show an optional embodiment wherein the manifold 12 includes a pair of saw cuts 42 and 44 that are made on each side of the manifold adjacent the pierced tube slot 14A and extend all the way into the slot 14A so as to remove all of the material except for a circumferential connecting tab 46 on the opposite side of the manifold 12 from the tube slots 14.

Figure 9A:
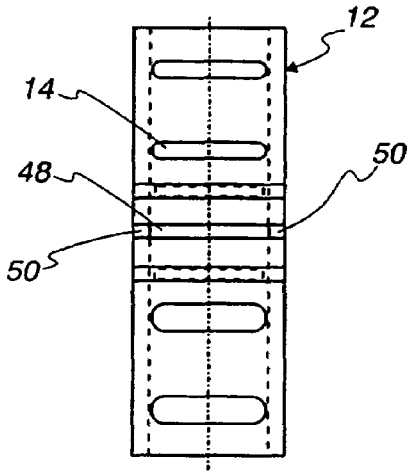
Figure 9B:
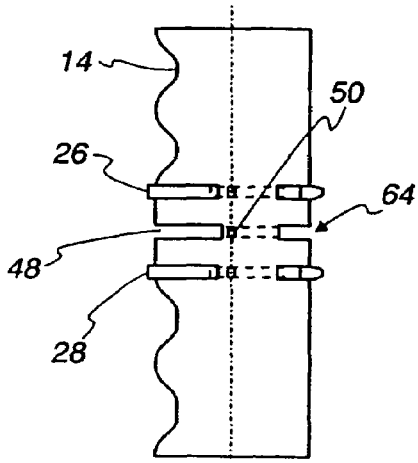

FIGS. 9A and 9B show an optional embodiment wherein the manifold 12 does not include a pierced tube slot 14A at the location between the baffles 26 and 28, but does include a baffle slot 48 that is of the same type as the slots 30 used for the baffles 26 and 28, and which leaves a pair of connection tabs 50 on each side of the manifold 12.

Figure 10A:
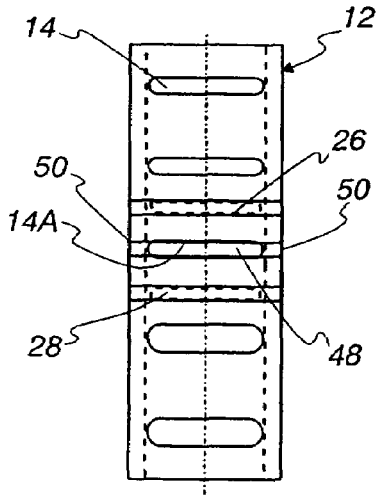
Figure 10B:
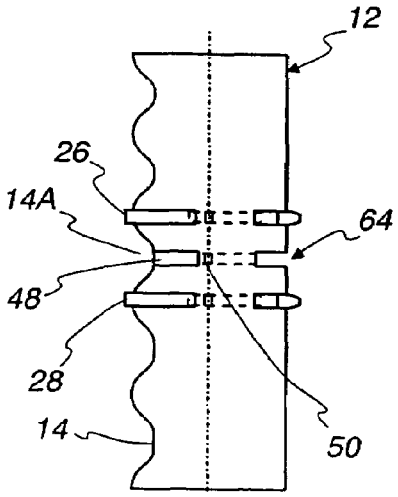

FIGS. 10A and 10B show an alternate embodiment similar to that of FIGS. 9A and 9B, but where the manifold 12 does include a pierced tube slot 14A at the location of the cut baffle slot 48.

Figure 11A:
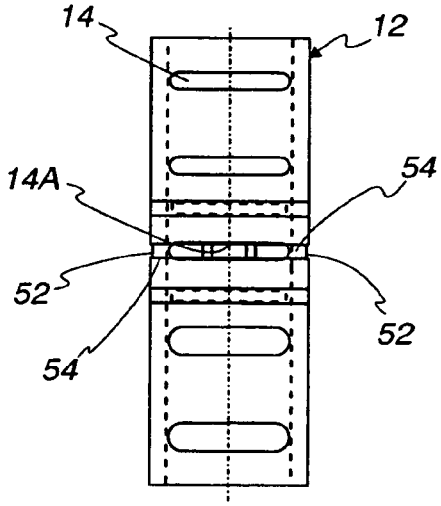
Figure 11B:
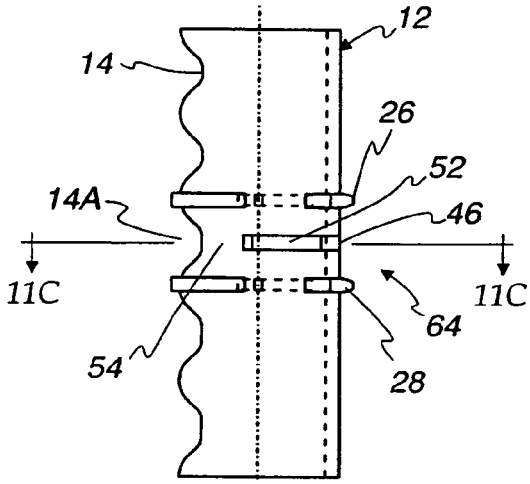
Figure 11C:
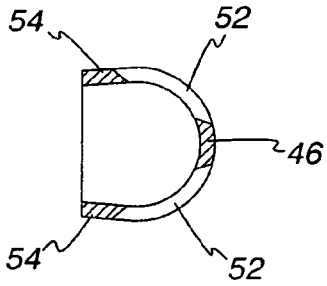

FIGS. 11A, 11B and 11C show yet another alternate embodiment wherein the manifold 12 includes a pierced tube slots 14A and has saw cuts 52 on each side similar to the embodiment of FIGS. 8A and 8B, but the saw cuts 52 do not extend into the tube slot 14A, thereby leaving the connection tab 46 and a pair of side tabs 54.

For each of the foregoing embodiments that include one or more connection tabs, the heat exchanger 10 can be installed intact, i.e., with the first and second sections 22 and 24 connected together by the connection tabs, and then the header sections 22 and 24 can be separated during operation by thermal stresses that result in the structural failure of the connection tabs.

It should be appreciated that the tubes 16, and preferably the associated fins 20, define a core section 60 for the cooler 10, and the tubes 18, and preferably the associated fins 20, define another core section 62 of the combo cooler 10. It should also be appreciated that the saw cuts 32,34,38,42, 44,52 and cut baffles slots 48 of each of the foregoing embodiments define a cut portion 64 in the corresponding manifold of the embodiment that is located between the pair of baffles 26 and 28. It can also be seen in the figures that, for each of the previously described embodiments, at least a majority of the transverse cross section of the header 12 has been removed at the cut portion 64 in comparison to the immediately adjacent transverse cross sections of the header 12.

While the above embodiments have been shown for a combination cooler wherein the common manifold has only first and second sections, the invention may prove useful in applications wherein there are more than two sections in the common manifold 12 and therefore more than two of the saw cuts 32, or the alternate embodiments thereto, in each of the manifolds 12.

The invention claimed is:

1. A multi-fluid heat exchanger for transferring heat between a first fluid and a common fluid in one part of the heat exchanger and between a second fluid and the common fluid in a second part of the heat exchanger, the heat exchanger comprising:

a first elongated header pipe having a plurality of tube receiving openings spaced along a length of the first header pipe; a second elongate header pipe having a plurality of tube receiving openings spaced along a length of the second header pipe;

a first core section comprising a plurality of parallel, spaced tubes, each of the tubes having a first end and a second end, with the first end received in a corresponding one of the tube receiving openings of the first header pipe and the second end received in a corresponding one of the tube receiving openings of the second header pipe to direct the first fluid between the first and second header pipes through an interior of the tube;

a second core section comprising a plurality of parallel, spaced tubes, each of the tubes having a first end and a second end, with the first end received in a corresponding one of the tube receiving openings of the first header pipe and the second end received in a corresponding one of the tube receiving openings of the second header pipe to direct the second fluid between the first and second header pipes through an interior of the tube, the second core spaced from the first core along the lengths of the first and second header pipes; and a pair of baffles located in the first header pipe at a location between the first and second cores to divide an interior of the first header pipe into a first fluid manifold for the first fluid and a second fluid manifold for the second fluid, the first header pipe includes a cut portion located between the pair of baffles, the cut portion having at least a majority of a transverse cross section of the header pipe removed in comparison to the immediately adjacent transverse cross sections of the first header pipe, wherein the cut portion is sized so that any remaining part of the transverse cross section of the first header pipe at the cut portion is severed under thermal cycling of the heat exchanger during operation of the heat exchanger.

2. The heat exchanger of claim 1 wherein all of the transverse cross section of the first header pipe has been removed in the cut portion, so that the first header pipe is separated into two unconnected pieces.

3. The heat exchanger of claim 1 wherein one of the tube openings of the first header pipe is located at the cut portion.

4. The heat exchanger of claim 3 wherein the one of the tube openings of the first header pipe does not have a tube end received therein.

5. The heat exchanger of claim 3 wherein the cut portion is defined by at least one saw cut extending through a portion of the header pipe outside of the one of the tube openings.

6. The heat exchanger of claim 3 wherein the cut portion is defined by a saw cut extending through a side of the header pipe immediately opposite from the one of the tube openings.

7. The heat exchanger of claim 3 wherein the cut portion is defined by a saw cut extending through the one of the tube openings.

8. The heat exchanger of claim 1 wherein the cut portion is defined by a pair of saw cuts extending through opposite respective sides of the first header pipe.

9. The heat exchanger of claim 1 wherein the cut portion is characterized by the absence of any of the tube openings.

10. The heat exchanger of claim 1 further comprising another pair of baffles located in the second header pipe at a location between the first and second cores to divide an interior of the second header pipe into a first fluid manifold for the first fluid and a second fluid manifold for the second fluid, the second header pipe including a second cut portion located between the another pair of baffles, the second cut portion having at least a majority of a transverse cross section of the header pipe is removed in comparison to the immediately adjacent transverse cross sections of the first header pipe.

11. A method of making a multi-fluid heat exchanger for transferring heat between a first fluid and a common fluid in one part of the heat exchanger and between a second fluid and the common fluid in a second part of the heat exchanger, the method comprising the steps of:

a) providing a heat exchanger with first and second parallel flow core sections extending between a pair of elongated header tubes, with each of the tubes having a first fluid manifold for the first core section and a second fluid for the second core section;

b) providing a cut portion in one of the elongated headers at a location between the first and second manifolds, the cut portion having at least part of the header connecting the first and second manifolds of the header;

c) thermal cycling the heat exchanger to sever the at least part of the one of the elongated headers so that the first and second manifolds of the header are no longer connected at the cut portion.

12. The method of claim 11 wherein step b) comprises providing the cut portion after the first and second core seconds are assembled and brazed together with the pair of elongated headers.

13. The method of claim 11 wherein step b) comprises providing the cut portion before the first and second core seconds are assembled and brazed together with the pair of elongated headers.

14. A multi-fluid heat exchanger for transferring heat between a first fluid and a common fluid in one part of the heat exchanger and between a second fluid and the common fluid in a second part of the heat exchanger, the heat exchanger comprising:

a first elongated header pipe having a plurality of tube receiving openings spaced along a length of the first header pipe; a second elongate header pipe having a plurality of tube receiving openings spaced along a length of the second header pipe;

a first core section comprising a plurality of parallel, spaced tubes, each of the tubes having a first end and a second end, with the first end received in a corresponding one of the tube receiving openings of the first header pipe and the second end received in a corresponding one of the tube receiving openings of the second header pipe to direct the first fluid between the first and second header pipes through an interior of the tube;

a second core section comprising a plurality of parallel, spaced tubes, each of the tubes having a first end and a second end, with the first end received in a corresponding one of the tube receiving openings of the first header pipe and the second end received in a corresponding one of the tube receiving openings of the second header pipe to direct the second fluid between the first and second header pipes through an interior of the tube, the second core spaced from the first core along the lengths of the first and second header pipes; and a pair of baffles located in the first header pipe at a location between the first and second cores to divide an interior of the first header pipe into a first fluid manifold for the first fluid and a second fluid manifold for the second fluid, the first header pipe includes a cut portion located between the pair of baffles, the cut portion having at least a majority of a transverse cross section of the header pipe removed in comparison to the immediately adjacent transverse cross sections of the first header pipe, wherein there is a serpentine fin extending between the first and second cores and connected to both the first and second cores.

15. The heat exchanger of claim 14 wherein all of the transverse cross section of the first header pipe has been removed in the cut portion, so that the first header pipe is separated into two unconnected pieces.

16. The heat exchanger of claim 14 wherein one of the tube openings of the first header pipe is located at the cut portion.

17. The heat exchanger of claim 14 wherein the cut portion is defined by a pair of saw cuts extending through opposite respective sides of the first header pipe.

18. The heat exchanger of claim 17 wherein the cut portion is defined by at least one saw cut extending through a portion of the header pipe outside of the one of the tube openings.

19. The heat exchanger of claim 17 wherein the cut portion is defined by a saw cut extending through a side of the header pipe immediately opposite from the one of the tube openings.

* * * * *